US005269364A

United States Patent [19]

Murata

[11] Patent Number: 5,269,364

[45] Date of Patent: Dec. 14, 1993

[54] LOW PRESSURE DIE CASTING APPARATUS

[75] Inventor: Yutaka Murata, Toyokawa, Japan

[73] Assignee: Sintokogio Ltd., Nagoya, Japan

[21] Appl. No.: 9,971

[22] Filed: Jan. 27, 1993

[30] Foreign Application Priority Data

Mar. 6, 1992 [JP] Japan ..... 4-084717
Mar. 13, 1992 [JP] Japan ..... 4-089495

[51] Int. Cl.[5] ..... B22D 18/04

[52] U.S. Cl. ..... 164/309; 164/342; 164/343

[58] Field of Search ..... 164/306, 309, 285, 342, 164/343, 119, 137

[56] References Cited

U.S. PATENT DOCUMENTS 3,749,154 7/1973 Plume ..... 164/306
3,862,656 1/1975 Weiler et al. ..... 164/306 X

FOREIGN PATENT DOCUMENTS 58-47558 3/1983 Japan ..... 164/306
603491 4/1978 U.S.S.R. ..... 164/306
831315 5/1981 U.S.S.R. ..... 164/306
850298 7/1981 U.S.S.R. ..... 164/306
869957 10/1981 U.S.S.R. ..... 164/306

*Primary Examiner*—J. Reed Batten, Jr.
*Attorney, Agent, or Firm*—Nikaido, Marmelstein, Murray & Oram

[57] ABSTRACT

One of a drag platen and a hold furnace for low pressure die casting, having a riser pipe projected from the upper part thereof, is made to be elevatable, and the drag platen on which a drag is set is made to be movable between a first position right above the hold furnace and a second position where the drag is away from the hold furnace while a cope platen to which a cope is set is made to be elevatable. At the first position, the cope platen is lowered so as to match the cope with the drag, and at the second position to which the drag platen is moved, the drag is accessed.

13 Claims, 8 Drawing Sheets

LOW PRESSURE DIE CASTING APPARATUS

BACKGROUND OF THE INVENTION

The present invention relates to a low pressure die casting apparatus in which molten metal such as aluminum alloy or the like pooled in a hold furnace is raised through a riser pipe under gas pressure, and is filled in a cavity defined between a cope and a drag which are matched together.

DESCRIPTION OF RELATED ART

In general, a horizontal split type die composed of a cope and a drag is used in a low pressure die casting apparatus in which the cope is raised from the fixed drag so as to part them from each other. Appurtenant work such as setting of cores and cleaning of a drag around sprues is required for a low pressure die casting process. That is, such appurtenant work is applied to the drag with the cope being raised. In this appurtenant work, there have been offered the following problems, that is, the worker has to stretch his body between the cope and the drag, causing a possible risk of crush by the elevated cope, and the working atmosphere is deteriorated by radiant heat from the cope and the drag.

SUMMARY OF THE INVENTION

The present invention is devised in view of the above-mentioned problems, and accordingly, one object of the present invention is to provide a low pressure die casting apparatus with which the appurtenant work such as setting of the cores and cleaning of the drag around its sprues can be safely and readily made.

To the end, according to the present invention, there is provided a low pressure die casting apparatus comprising:

a hold furnace for low pressure die casting, having a riser pipe projected upward;

a drag platen adapted to be attached thereto with a drag having a sprue which is directed downward;

a horizontal shift means for horizontally moving the drag platen between a position right above the hold furnace and a position spaced from the former position;

a first vertical shift means for vertically moving one of the drag platen and the hold furnace with respect to the other of them so as to make the riser pipe communicate with the sprue in the drag;

a cope platen adapted to be attached thereto with a cope; and a second vertical shift means for holding the cope platen above the hold furnace and for vertically moving the cope platen to said drag platen so as to match the cope with the drag.

With this arrangement, the drag can be introduced into and extracted from a position below the cope in the low pressure die casting apparatus together with the drag platen so that both casting work and appurtenant work such as setting of cores and cleaning of the drag around the sprues can be safely and readily made, thereby it is possible to surely carry out a low pressure die casting process and as well to safely and readily perform the appurtenant work to the drag.

Other features and advantages of the invention will be apparent from the following description taken in connection with the accompanying drawings in which:

DESCRIPTION OF THE PREFERRED EMBODIMENTS

Figure 1:
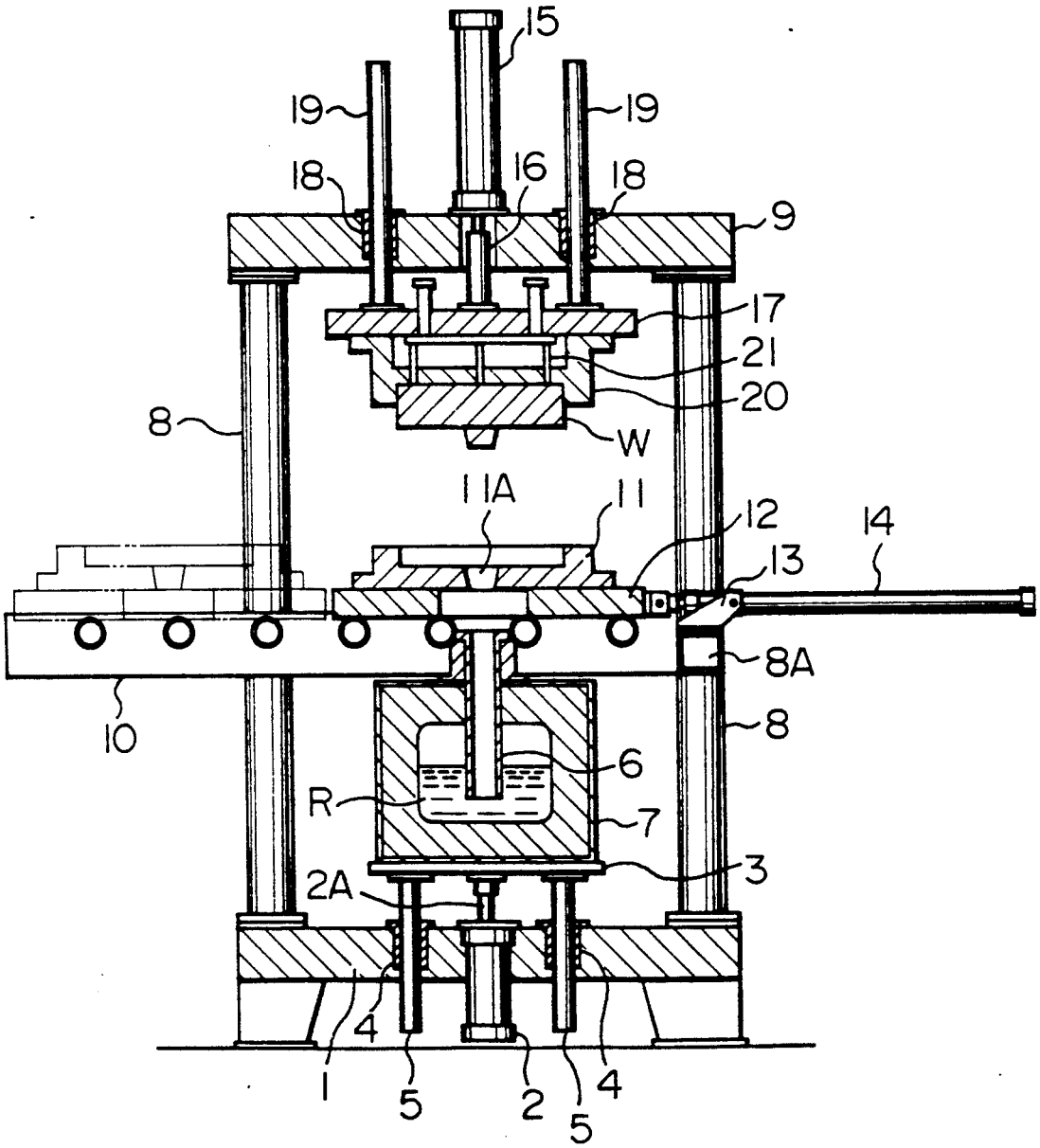
FIG. 1 is a front view, partly in section, illustrating a first embodiment of the present invention.

Explanation will be made hereinbelow of a first embodiment of the present invention with reference to FIGS. 1 to 5.

A table 3 is fixed to the forward end of a piston rod 2A in an upward directed cylinder 2 provided in the center section of a base 1, and guide rods 5 which are slidably fitted in the vertical direction in guide bushings 4 mounted in the base 1, are attached to the lower surface of the table 3. A hold furnace 7 for low pressure die casting, from which a riser pipe 6 projects upward, is installed on the table 3 so that the hold furnace 7 can be vertically raised and lowered under the operation of the cylinder 2.

An overhead frame 9 is fixed to the upper ends of support columns 8 which are planted on the base 1 at four corners thereof, so that the overhead frame 9 spans between the support columns 8. Further, a roller conveyer 10 in two rows is laid transversely so as to be extended to a position outside of the apparatus, on the left side as viewed in FIG. 1, at a height slightly higher than the hold furnace 7.

A drag platen 12 which is attached on its upper part with a drag 11 incorporating a sprue 11A is arranged on the roller conveyer 10. Further, the drag platen 12 is pinned to a horizontal cylinder 14 which is attached, being directed inward, to a frame 8A laid between two support columns 8 on the right side as viewed in FIG. 1, through the intermediary of a bracket 13.

Figure 3:
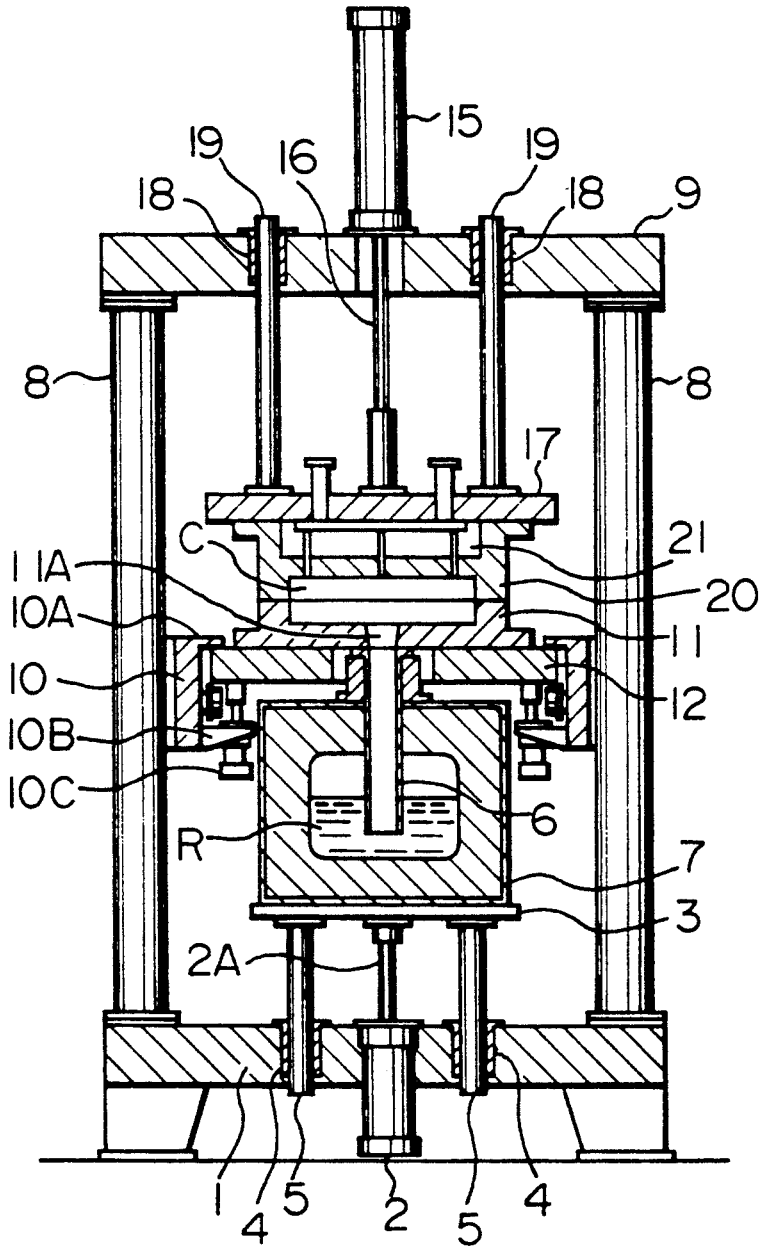
FIG. 3 is a side view, partly in section, illustrating the first embodiment in a condition just before the initiation of a casting work.

The roller conveyer 10 in two rows is formed thereto with flanges 10A which project inward from the upper sections of the conveyer 10, above the hold furnace 7, and it is further provided thereto with brackets 10B which project from the lower sections of the conveyer 10 and which are provided thereto with upward clamp cylinders 10C. As shown in FIG. 3, when piston rods of the clamp cylinders 10C are extended, the drag platen 12 is pushed upward from the roller conveyer 10, and is pressed against the flanges 10A so that the drag platen 12 is clamped firmly.

A cope platen 17 is secured to the lower end of a piston rod 16 in a downward directed cylinder 15 provided in the center section of the overhead frame 9. Guide rods 19 which are slidably fitted in the vertical direction in guide bushings 18 mounted in the overhead frame 9, are attached to the upper surface of the cope platen 17.

A cope 20 which can be matched with the drag 11 is set to the lower part of the cope platen 17, and an eject pin mechanism 21, (the construction of which is well known itself) for ejecting a casting W from the cope 20 is provided between the cope platen 17 and the cope 20. Accordingly, the cope 20, the cope platen 17 and the eject pin mechanism 21 constitute a unit as a whole.

Explanation will be made hereinbelow of the operation of the low pressure die casting apparatus in the first embodiment.

Figure 2:
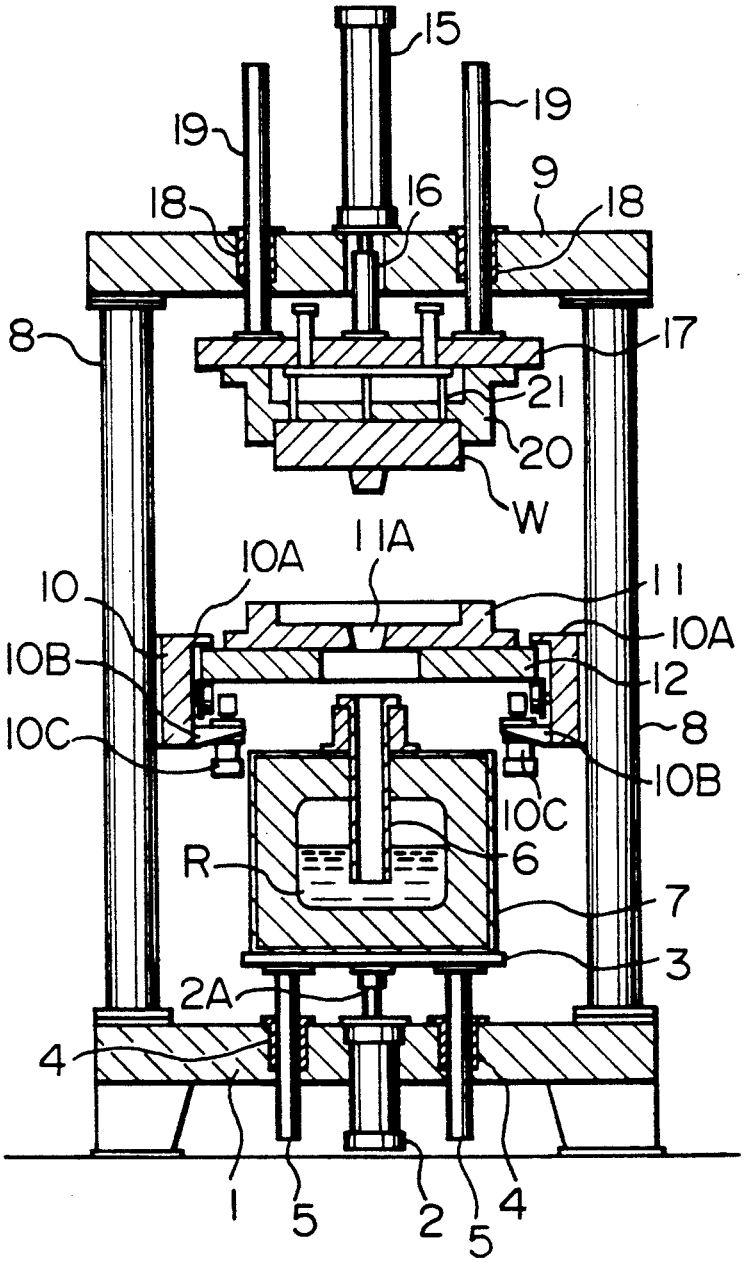
FIG. 2 is a side view, partly in section, illustrating the first embodiment shown in FIG. 1.

FIGS. 1 and 2 show such a condition that the cope 20 and the drag 12 are separated with the casting W being attached to the cope 20, and the clamp of the drag platen 12 is released after completion of a low pressure die casting. In this condition, the horizontal cylinder 14 is operated so that the drag 11 is moved together with the drag platen 12 on the roller conveyer 10 to a position indicated by a chain line in FIG. 1, and is held at that position where appurtenant work to the drag 11, such as cleaning of the drag 11 around the sprue 11A and setting of a core is carried out.

During this period, a casting receiver which is not shown is arranged below the casting W, and then the piston rod 16 of the cylinder 15 is retracted to operate the eject pin mechanism 21 in order to drop the casting W from the cope 20 onto the casting receiver which is then transferred to a position outside of the apparatus.

Next, the horizontal cylinder 14 is reversed so that the drag 11 in which the core is set, is moved together with the drag platen 12 on the roller conveyer 10 to a position right above the hold furnace 7, and thereafter, the clamp cylinders 10C are operated so as to clamp the drag platen 12 in cooperation with the flanges 10A as shown in FIG. 3.

Next, the piston rod 16 of the cylinder 15 is extended so that the cope 20 is lowered together with the cope platen 17 down to a position where the cope 10 is matched with the drag 11. Then, the cylinder 2 is operated so that the hold furnace 7 and the riser pipe 6 are raised up to a position where the riser pipe 6 is pressed against the sprue 11A in the drag 11 so as to make the riser pipe 6 communicate with the sprue 11A, as shown in FIG. 3.

In this condition, compressed air is fed into the hold furnace 7 from an air feed port which is not shown, and accordingly, molten metal R is filled into the cavity C through the riser pipe 6. This pressurized condition is held until the molten metal is solidified, and then, the supply of compressed air to the hold furnace 7 is stopped while compressed air is discharged from the hold furnace 7 so that the molten metal R in the riser pipe 6 is returned into the hold furnace 7. Next, the piston rod 2A of the cylinder 2 is retracted so that the riser pipe 6 is lowered together with the hold furnace 7, and accordingly, the communication between the riser pipe 6 and the sprue 11A is stopped. Thereafter, the cylinder 15 is operated so that the cope 20 attached thereto with the casting W is raised together with the cope platen 17 up to a position as shown in FIGS. 1 and 2.

Then, the clamp cylinders 10C are reversed so as to release the drag platen 12 from their clamped condition as shown in FIG. 2. Then the above-mentioned steps are repeated for the next low pressure die casting process.

The roller conveyer 10 can be also used for replacement of the drag and cope for a different casting work.

Figure 4:
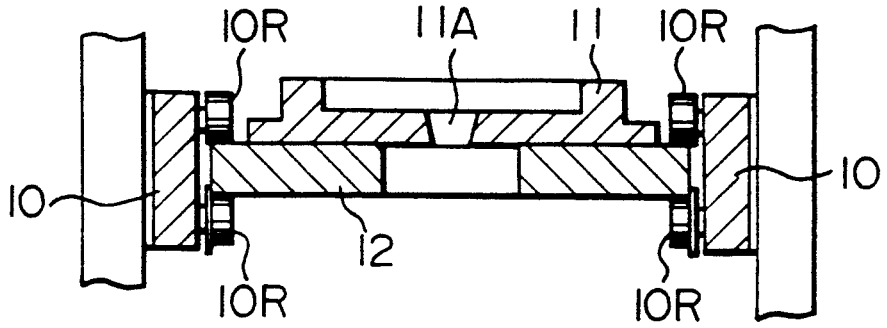
FIG. 4 is a side view illustrating a variant form of a shift mechanism incorporating a clamp means for a drag platen in the first embodiment.
Figure 5:
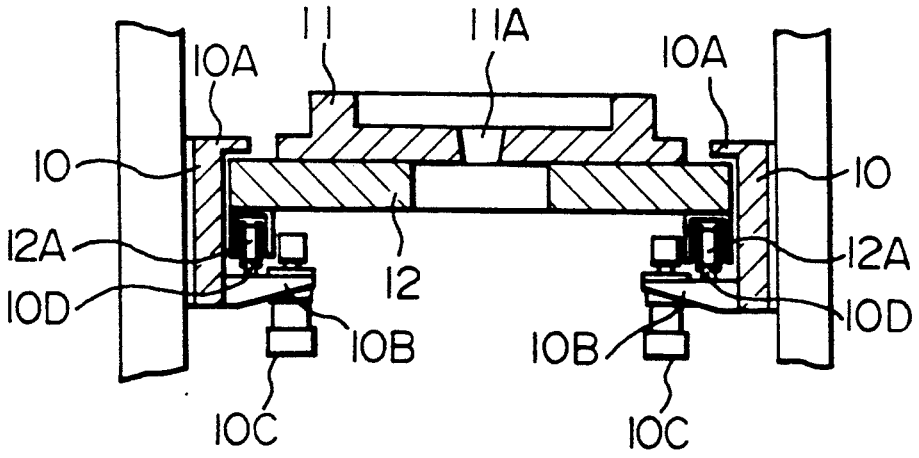
FIG. 5 is a side view illustrating a further variant form of the shift mechanism incorporating the clamp means for the drag platen in the first embodiment.

It is noted that one example of the shift mechanism incorporating the clamp means for the drag platen 12 has been explained in the first embodiment, but a different mechanism as shown in FIGS. 4 or 5 can be also used.

That is, as shown in FIG. 4, the roller conveyer 10 is provided with upper and lower rollers 10R, and the drag platen 12 is moved being always held or clamped between the upper and lower rollers 10R, 10R, that is, the upper and lower rollers 10R, 10R serve as the clamp means.

Further, as shown in FIG. 5, rails 10D are laid on the brackets 10B in the above-mentioned embodiment while wheels 12A adapted to roll on the rails 10D are provided to the drag platen 12 in order to shift the latter.

Next explanation will be made of a second embodiment of the present invention in detail with reference to FIGS. 6 to 10. A hold furnace 53 for low-pressure die casting, having a riser pipe 52 which projects from the upper part thereof is set on a base 51, and cylinders 54 are planted on the base 51 on both sides of the hold furnace 53. The upper ends of piston rods 55 in the cylinders 54 are coupled to lower sections of the first roller conveyer 56 in two rows. That is, the roller conveyer 56 is made to be elevatable in association with the operation of the cylinders 54.

Figure 6:
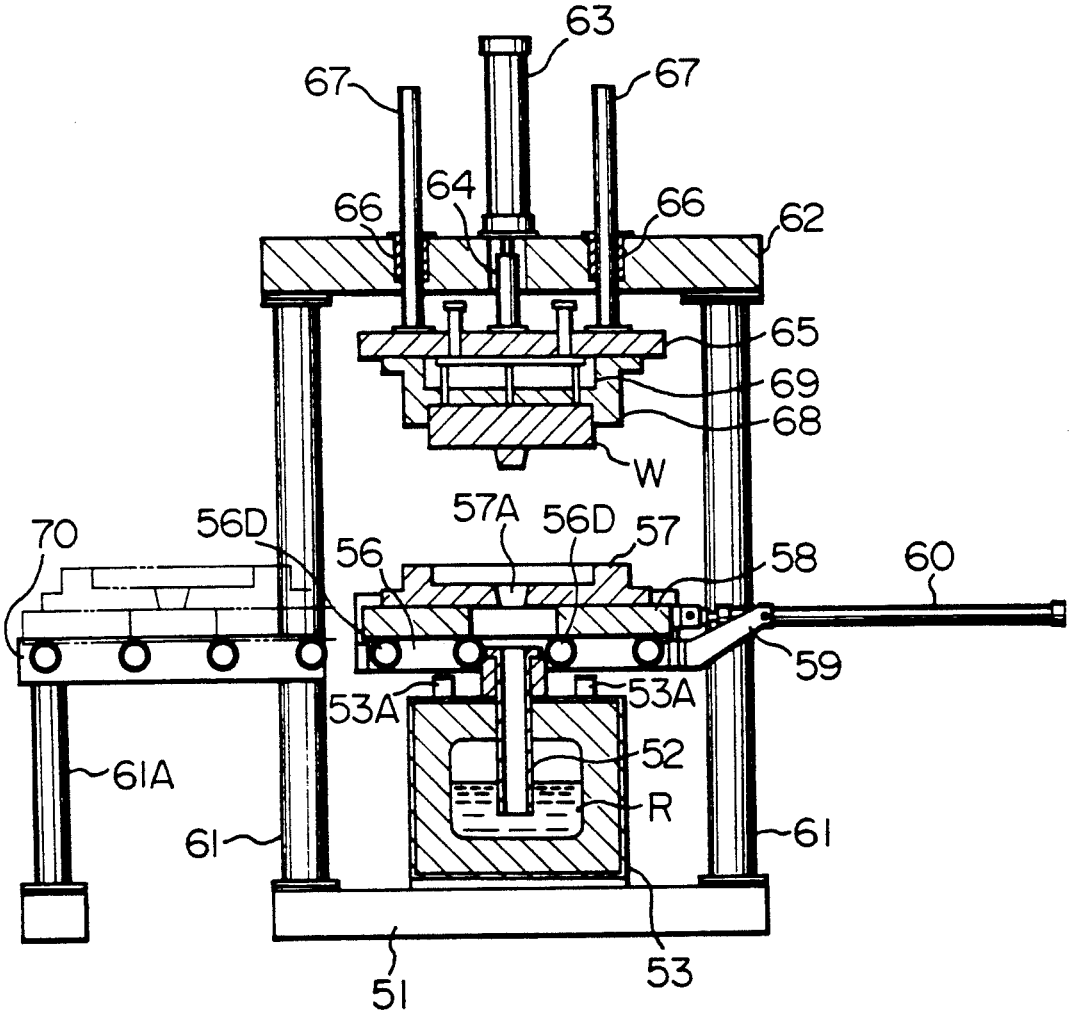
FIG. 6 is a front view, partly in section, illustrating a second embodiment of the present invention.

A drag platen 58 mounted on its upper section with a drag 57 incorporating a sprue 57A is arranged on the first roller conveyer 56. Further, the drag platen 58 is pinned to an inward directed horizontal cylinder 60 which is attached to the right end of the roller conveyer 56 through the intermediary of a bracket 59 as shown in FIG. 6.

The first roller conveyer 56 is formed at its upper section with inward directed flanges 56A.

An overhead frame 62 is fixed to the upper ends of support columns 61 planted on the base 51 at its four corners so that the overhead frame 62 spans between the support columns 61, and a downwardly directed cylinder 63 is provided to the center part of the overhead frame 62. A cope platen 65 is fixed to the lower end of a piston rod 64 in the cylinder 63, and guide rods 67 which are slidably fitted in the vertical direction in guide bushings 66 mounted in the overhead frame 62, are attached to the upper surface of the cope platen 65.

A cope 68 which can be matched with the drag 57 is attached to the lower part of the cope platen 65, and a eject pin mechanism 69 for ejecting a casting W from the cope 68 is provided between the cope platen 65 and the cope 68. Accordingly, the cope 68, the cope platen 65 and the eject pin mechanism 69 constitute a unit as a whole.

Second roller conveyer 70 in two rows is supported by and fixed to the support columns 61 and supports 61A planted on the left side of the apparatus is supported on the same level as the first roller conveyer 56 when the first roller conveyer 56 is in an elevated position. Further, stoppers 53A for limiting the downward movement of the drag platen 58 and for clamping the drag platen 58 between themselves and the flanges 56A of the first roller conveyer 56 are provided on the upper part of the hold furnace 53.

Explanation will be made hereinbelow of the operation of the low pressure die casting apparatus in the second embodiment of the present invention.

Figure 7:
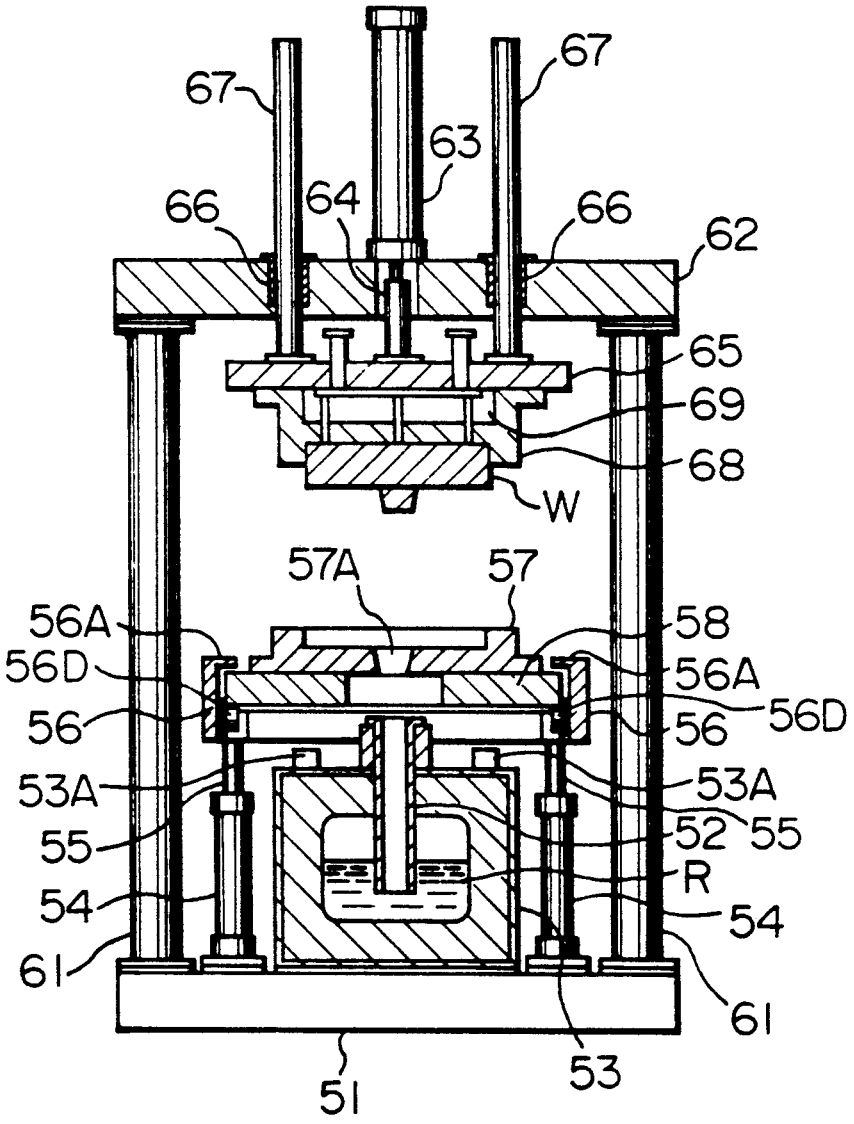
FIG. 7 is a side view, partly in section, illustrating the second embodiment shown in FIG. 6.

FIGS. 6 and 7 show such a condition that the cope 68 and the drag 57 are separated with the casting W being attached to the cope 68 after completion of a low pressure die casting work, and the piston rods 55 of the cylinders 54 are extended to raise the first roller conveyer 56 up to the level of the second roller conveyer 70 while the communication between the riser pipe 52 and the sprue 57A is stopped. In this condition, the horizontal cylinder 60 is operated so that the drag 57 is shifted together with the drag platen 58 from the first roller conveyer 56 onto the second roller conveyer 70, and is then stopped at a position indicated by a chain line in FIG. 6, where the appurtenant work such as cleaning of the drag 57 around the sprue 57A and setting of a core is carried out. During this period, a casting receiver which is not shown is arranged below the casting W, and the piston rod 64 of the cylinder 63 is retracted to operate the eject pin mechanism 69 in order to drop the casting W from the cope 68 onto the casting receiver which is then transferred outward from the apparatus.

Then, the horizontal cylinder 60 is reversed so that the drag 57 in which the core is set is shifted together with the drag platen 58 from the second roller conveyer 70 onto the first roller conveyer 56 to a position where the first roller conveyer 56 is then lowered in association with the retracting operation of the cylinders 54. During the downward movement the drag platen 58 abuts against the stoppers 53A, 53A on the upper part of the hold furnace 53, and accordingly, the downward movement is stopped while the upper end of the riser pipe 52 is pressed against the lower end of the sprue 57A in the drag 57. Further, the piston rods 55 of the cylinders 54 are retracted to lower the first roller conveyer 56 down to a position where the drag platen 58 is floated up from the rollers 56D and is made at its upper surface into contact with the flanges 56A, that is, the drag platen 58 is clamped between the stoppers 53A and the flanges 56A while the riser pipe 52 is pressed against the sprue 57A.

Figure 8:
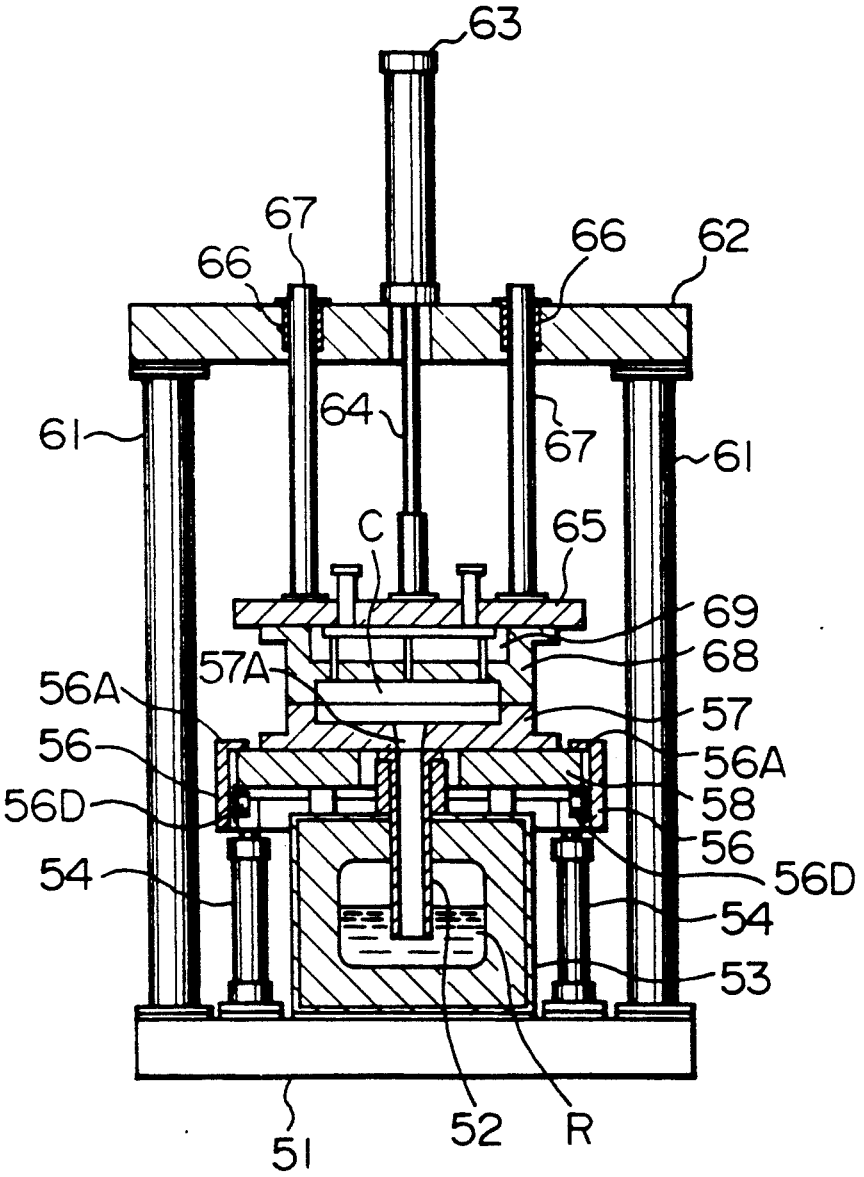
FIG. 8 is a side view, partly in section, illustrating the second embodiment in a condition just before the initiation of a casting work.

Then, the piston rod 64 of the cylinder 63 is extended so that the cope 68 is lowered together with the cope platen 65 down to a position where the cope 68 is matched with the drag 57, as shown in FIG. 8.

In this condition, compressed air is introduced into the hold furnace 53 from an air feed port which is not shown so as to fill molten metal R into the cavity C through the riser pipe 52. This pressurized condition is held until the molten metal R is solidified. Then the supply of compressed air into the hold furnace 53 is stopped while the compressed air in the hold furnace 53 is discharged. Thus, the molten metal is returned into the hold furnace 53 from the riser pipe 52.

Next, the cylinder 63 is operated so that the cope 68 attached thereto with the casting W is raised together with the cope platen 65 up to the position shown in FIGS. 6 or 7. Meanwhile, the piston rods 54A of the cylinders 54 are extended to raise the roller conveyer 56 so as to release the clamped condition of the drag platen 58 clamped between the stoppers 53A and the flanges 56A while the communication between the riser pipe 52 and the sprue 57A is stopped as shown in FIGS. 6 and 7. Then, the above-mentioned steps are repeated.

It is noted that the second roller conveyer 70 in the second embodiment can be eliminated, and instead, the first roller conveyer 56 is extended outside of the apparatus to be made elevatable in its entirety.

An example of the shift mechanism incorporating the clamp means for the drag platen 58 is explained in the second embodiment. However, a different type of shift mechanism can be used therefor, as shown in FIG. 9 or 10.

Figure 9:
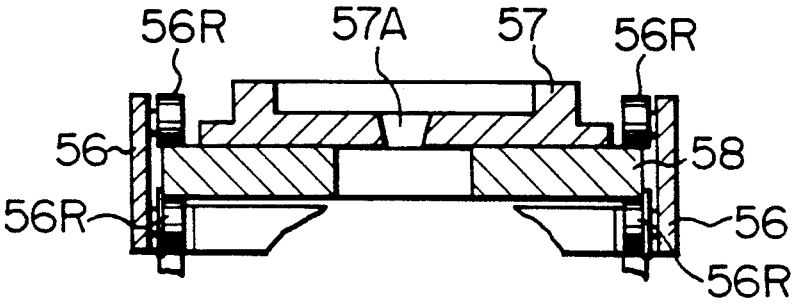
FIG. 9 is a side view illustrating a variant form of a shift mechanism incorporating a clamp means for a drag platen in the second embodiment.

That is, as shown in FIG. 9, the first roller conveyer 56 is provided with upper and lower rollers 56R, 56R and the drag platen 58 is shifted being always clamped between the upper and lower rollers 56R, 56R. In this case, the stoppers 53A can be eliminated, and the retraction operation of the cylinders 54 is limited to control the communication between the riser pipe 52 and the sprue 57A.

Figure 10:
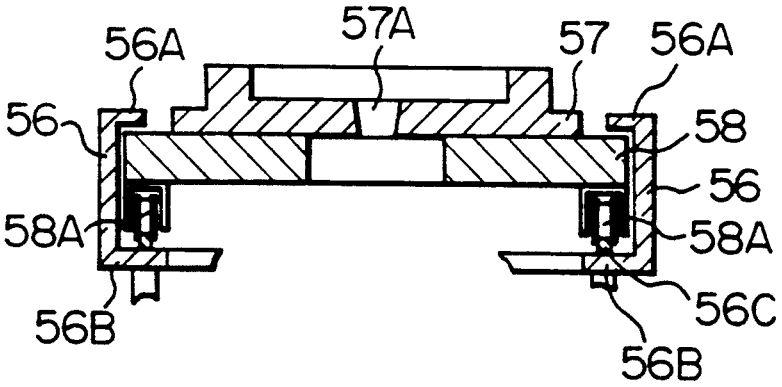
FIG. 10 is a side view illustrating a further variant form of the shift mechanism incorporating the clamp means for the drag platen in the second embodiment.

Further, as shown in FIG. 10, flanges 56B are also provided being projected from the lower sections of the first roller conveyer 56, and rails 56C are laid on the flanges 56B. Accordingly, the drag platen 58 is provided thereto with wheels 58A which roll on the rails 56C in order to shift the drag platen 58.

What is claimed is:

1. A low pressure die casting apparatus comprising:

a hold furnace for low pressure die casting, having a riser pipe projected upward;

a drag platen adapted to be attached thereto with a drag having a sprue which is directed downward;

a horizontal shift means for horizontally moving said drag platen between a position right above said hold furnace and a position spaced from the former position;

a first vertical shift means for vertically moving one of said drag platen and said hold furnace with respect to the other of them so as to make said riser pipe communicate with said sprue in said drag;

a cope platen adapted to be attached thereto with a cope; and a second vertical shift means for holding said cope platen above said hold furnace and for vertically moving said cope platen to said drag platen so as to match said cope with said drag.

2. A low pressure die casting apparatus as set forth in claim 1, wherein said horizontal shift means includes a horizontally extended track means, and is provided with a clamp means for clamping said drag platen at the position right above said hold furnace so as to limit vertical movement thereof with respect to said track means.

3. A low pressure die casting apparatus as set forth in claim 2, wherein said track means is composed of a fixed conveyer, and said first vertical shift means is composed of a cylinder for elevating said hold furnace.

4. A low pressure die casting apparatus as set forth in claim 3, wherein said clamp means includes flanges formed on said conveyer, and clamp cylinders provided to said conveyer, for pressing said drag platen against said flanges.

5. A low pressure die casting apparatus as set forth in claim 3, wherein said clamp means is composed of upper and lower rollers for vertically clamping said drag platen therebetween.

6. A low pressure die casting apparatus as set forth in claim 3, said conveyer includes rails, and said drag platen includes wheels which roll on said rails.

7. A low pressure die casting apparatus as set forth in claim 2, said track means includes a vertically movable conveyer, and said first vertical shift means includes a cylinder for elevating said conveyer.

8. A low pressure die casting apparatus as set forth in claim 7, wherein said clamp means includes flanges provided to said conveyer, and stoppers provided on said hold furnace, and said drag platen is clamped between said flanges and said stoppers by means of said cylinder.

9. A low pressure die casting apparatus as set forth in claim 7, wherein only a part of said track means which positions above said hold furnace can be moved vertically, while the remaining part of said track means is stationary.

10. A low pressure die casting apparatus as set forth in claim 7, wherein said clamp means is composed of upper and lower rollers provided to said conveyer, for vertically clamping said drag platen therebetween.

11. A low pressure die casting apparatus as set forth in claim 7, wherein said conveyer includes rails, and said drag platen includes wheels which roll on said rails.

12. A low pressure die casting apparatus as set forth in claim 1, wherein said horizontal shift means is composed of a roller conveyer.

13. A low pressure die casting apparatus as set forth in claim 1, wherein a worker can access said drag platen when said drag platen is shifted from the position right above the hold furnace to the position spaced from the former position by said horizontal shift means.

* * * * *